US005298385A

United States Patent [19]

Chang et al.

[11] Patent Number: 5,298,385

[45] Date of Patent: Mar. 29, 1994

[54] HIGH CHLORIDE FOLDED TABULAR GRAIN EMULSIONS

[75] Inventors: Yun C. Chang; Donna J. McPhillips, both of Rochester, N.Y.

[73] Assignee: Eastman Kodak Company, Rochester, N.Y.

[21] Appl. No.: 60,945

[22] Filed: May 12, 1993

Related U.S. Application Data

[63] Continuation-in-part of Ser. No. 898,613, Jun. 15, 1992, abandoned.

[51] Int. Cl.[5] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,379,837 | 4/1983 | Lapp et al. | 430/569 |
| 4,400,463 | 8/1983 | Maskasky | 430/569 |
| 4,419,443 | 12/1983 | Mifune et al. | 430/569 |
| 4,713,323 | 12/1987 | Maskasky | 430/569 |
| 4,764,457 | 8/1988 | Hotta et al. | 430/569 |
| 4,783,398 | 11/1988 | Takada et al. | 430/567 |
| 4,804,621 | 2/1989 | Tufano et al. | 430/567 |
| 4,868,102 | 9/1989 | Ogi et al. | 430/569 |
| 4,952,491 | 8/1990 | Nishikawa et al. | 430/567 |

FOREIGN PATENT DOCUMENTS

| | | |
|---|---|---|
| 63248844 | 4/1983 | Japan . |
| 59-214029 | 5/1983 | Japan . |
| 1447307 | 8/1976 | United Kingdom . |
| 1529440 | 10/1978 | United Kingdom . |
| 8302338 | 7/1983 | World Int. Prop. O. . |

OTHER PUBLICATIONS

"The Seven Different Kinds of Crystal Forms of Photographic Silver Halides", Maskasky, J. E., Journal of Imaging Science, vol. 30, No. 6, pp. 247-254 (1986).

*Primary Examiner*—Janet C. Baxter
*Attorney, Agent, or Firm*—Carl O. Thomas

[57] ABSTRACT

A process is disclosed of preparing an emulsion comprised of dispersing medium and folded tabular grains containing at least 95 mole percent chloride, based on total silver. This is achieved by maintaining a chloride ion concentration of at least 0.5 molar in the dispersing medium while the grain nuclei are being formed and during grain growth maintaining in the dispersing medium a pH in the range of from 1 to 8 and an effective concentration of 2-hydroaminoazine or xanthinoid morphological modifier in the range of from a $5\times10^{-5}$ to $2\times10^{-2}$ millimolar concentration.

4 Claims, 4 Drawing Sheets

1 μm

10 μm

HIGH CHLORIDE FOLDED TABULAR GRAIN EMULSIONS

This is a continuation-in-part of U.S. Ser. No. 898,613, filed Jun. 15, 1992, now abandoned.

FIELD OF THE INVENTION

The invention relates to novel photographic emulsions and processes for their preparation.

BACKGROUND OF THE INVENTION

Photographically useful silver halide emulsions, other than high (>90 mole %) iodide emulsions, which are seldom used for photographic purposes, contain silver halide grains that exhibit a face centered cubic crystal lattice structure. Face centered cubic crystal lattice structure silver halides can take different crystallographic forms, depending of the crystal faces by which they are bounded. J. E. Maskasky, "The Seven Different Kinds of Crystal Forms of Photographic Silver Halides", *Journal of Imaging Science,* Vol. 30, No. 6, Nov./Dec. 1986, pp. 247–254, states that there are seven possible crystal planes or families of crystal planes that can bound face centered cubic crystal lattice structure silver halide grains. These are cubic or {100}; octahedral or {111}; rhombic dodecahedral or {110}; trisoctahedral or {hh1}; tetrahexahedral or {hk0}; icositetrahedral or {h11}; and hexoctahedral or {hk1} grain faces. The descriptive name is derived from the geometrical form of regular grains bounded only by the stated face while the numerical name is the Miller index of the crystal face. h, k and 1 are integers, where h is larger than k and 1 is smaller than h.

Despite the theoretical availability of different crystal forms, photographic silver halide grains rarely exhibit any crystal faces other than {111} or {100} crystal faces. The variety of shapes that silver halide grains exhibit is much more a function of crystal irregularities than variations in grain face crystal planes. Silver chloride grains show a strong propensity toward forming cubic grains bounded entirely by {100} crystal faces, although both cubic and octahedral grains of all face centered cubic crystal lattice structure silver halides are known as well as cubo-octahedral grains. That is, grains with six {100} faces and eight {111} faces, sometimes also referred to as tetradecahedral grains. In addition irregular grains, such as clam form grains (believed to contain a single twin plane) of the type discloses by U.K. Patent Specifications 1,447,307 and 1,529,440; acicular or rod like grains; and multiply twinned grains are all known.

In the 1980's a marked advance took place in silver halide photography based on the discovery that a wide range of photographic advantages, such as improved speed-granularity relationships, increased covering power (both on an absolute basis and as a function of binder hardening), more rapid developability, increased separation of native spectral sensitization imparted imaging speeds, and improved image sharpness in both mono- and multilayer formats, can be realized by producing emulsions in which greater than 50 percent of total grain projected area is accounted for by tabular grains. With the exception of {100} silver bromide tabular grains, tabular grain emulsions contain tabular grains with {111} major faces. They are believed to result from the incorporation of two or more parallel twin planes. Tabular grains are characterized by two parallel major faces that are much larger than any remaining crystal faces of the grains.

Silver bromide tabular grains are the most easily prepared, following by silver iodobromide, silver chlorobromide and silver chloride tabular grains in that order. Although high (>50 mole percent) chloride tabular grain emulsions are known, some difficulties have arisen. Whereas tabular grains have {111} major faces, silver chloride prefers to form grains having {100} faces. Thus, there has been a tendency of high chloride tabular grains to revert to non-tabular forms—i.e., grain stability has been a problem. This problem has been overcome by employing morphological modifiers in preparing high chloride tabular grain emulsions, as taught by Tufano et al U.S. Pat. No. 4,804,621; Takada et al U.S. Pat. No. 4,783,398; and Maskasky U.S. Pat. Nos. 4,400,463 and 4,713,323.

In addition to the specific prior art discussed above it is noted that Lapp et al U.S. Pat. No. 4,379,827; Mifune et al U.S. Pat. No. 4,419,443; Hotta et al U.S. Pat. No. 4,764,457; Ogi et al U.S. Pat. No. 4,868,102; Nishikawa et al U.S. Pat. No. 4,952,491; Japanese Kokai 59-214029; Japanese Kokai 63-2409844; and WO 83/02338 (EPO 96,727 corresponding) were placed of record and considered by the Examiner in the parent application, but not selected as forming a basis for rejection.

Recently increased interest has developed in high chloride emulsions. The much higher solubility of silver chloride as compared to silver bromide offers processing advantages, and there are indications that effluents from processing high chloride emulsions can be reduced and more easily managed to satisfy rising ecological protection standards.

With increased interest in high chloride photographic emulsions an unsatisfied need has been identified. That need is for a high chloride photographic emulsion that has the advantages of tabular grain emulsions, but offers the morphological grain stability of cubic or {100} grain face high chloride emulsions.

RELATED PATENT APPLICATIONS

Maskasky U.S. Ser. No. 08/035,349, filed Mar. 22, 1993, titled HIGH TABULARITY HIGH CHLORIDE EMULSIONS WITH INHERENTLY STABLE GRAIN FACES, which is a continuation-in-part of U.S. Ser. No. 955,010, filed Oct. 1, 1992, now abandoned, which is in turn a continuation-in-part of U.S. Ser. No. 764,868, filed Sep. 24, 1991, now abandoned, discloses high chloride high aspect ratio tabular grain emulsions in which the tabular grains have {100} major faces.

House et al U.S. Ser. No. 08/034,060, filed Mar. 22, 1993, titled HIGH ASPECT RATIO TABULAR GRAIN EMULSIONS, which is a continuation-in-part of U.S. Ser. No. 940,404, filed Sep. 3, 1992, now abandoned, which is a continuation-in-part of U.S. Ser. No. 826,338, filed Jan. 27, 1992, now abandoned, discloses high chloride high aspect ratio tabular grain emulsions in which the tabular grains have {100} major faces.

SUMMARY OF THE INVENTION

In one aspect the invention is directed to a process of preparing a tabular grain emulsion comprised of dispersing medium and radiation sensitive silver halide containing at least 95 mole percent chloride, based on total silver, comprising (1) forming grain nuclei by introducing silver ion into a dispersing medium containing chloride ion and a morphological modifier and (2)

growing the grains in the presence of the morphological modifier to form tabular grains, wherein the formation of folded tabular grains accounting for at least 50 percent of total grain projected area is achieved by (a) maintaining a chloride ion concentration of at least 0.5 molar in the dispersing medium while the grain nuclei are being formed and (b) during grain growth maintaining in the dispersing medium a pH in the range of from 1 to 8 and an effective concentration of the morphological modifier in the range of from a $5\times10^{-5}$ to $2\times10^{-2}$ millimolar concentration, where the morphological modifier is chosen from the group consisting of 2-hydroaminoazine and xanthinoid morphological modifiers and the effective concentration of the morphological modifier present is related to the total concentration of the morphological modifier present in the following manner:

$$EC=TC\div[1+10^{(pKa-pH)}]$$

where

EC is the millimolar effective concentration of the morphological modifier;

TC is the millimolar total concentration of the morphological modifier;

pKa is the negative log of the acid dissociation constant of the morphological modifier; and pH is the negative log of the hydrogen ion concentration.

In another aspect the invention is directed to a photographic emulsion comprised of a dispersing medium and radiation sensitive silver halide grains, wherein at least 50 percent of the total grain projected area is accounted for by folded tabular grains containing at least 95 mole percent chloride, based on silver.

The advantage of the invention is that a novel high chloride tabular grain emulsion is made available to the art. Advantages associated with the tabular grain shape are realized, and folded tabular shape of the grains appears morphologically stable. Another advantage of the invention is that lower concentrations of morphological modifier are effective than have been employed for producing high chloride {111} tabular grains. In addition spectrally sensitized folded tabular grains offer the possibility of higher light absorption than can be realized by conventional (planar) tabular grains.

BRIEF DESCRIPTION OF THE DRAWING FIGURES

DETAILED DESCRIPTION OF THE INVENTION

The invention is directed to a photographic emulsion comprised of dispersing medium and radiation sensitive silver halide grains. At least 50 percent (preferably at least 70 percent) of the total grain projected area is accounted for by folded tabular grains containing at least 95 mole percent chloride, based on silver.

Figure 1A:
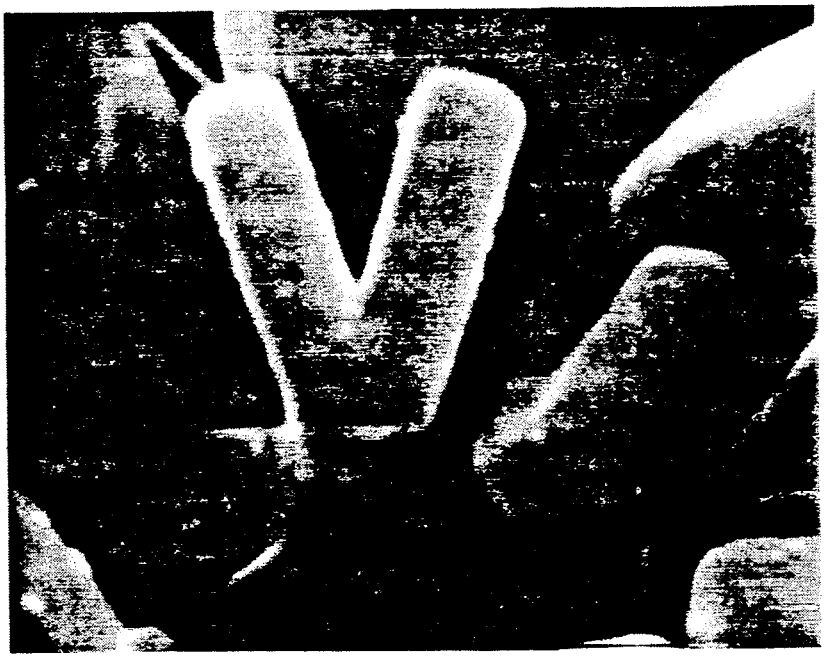
FIG. 1A is a photomicrograph showing a folded tabular grain on edge.

In FIG. 1A a photomicrograph shows an edge view of a folded tabular grain. Viewed on edge, the tabular grain presents a V shape. There are two tabular grain portions diverging at an acute angle from a common base portion that joins them. As shown, the acute angle formed by the projection of the adjacent, hereinafter designated inner, surfaces of the tabular grain portions is approximately 36°. Although the grain shown in FIG. 1A appears ideally oriented for measurement of the angle of divergence, it is in general difficult to measure the angles of divergence accurately, since the folded tabular grains are randomly oriented. Nevertheless, it is apparent from observation of grains in a number of photomicrographs that the angle of divergence is in all instances less than 45°.

The halide content of the grains, which is at least 95 mole percent chloride, based on total silver, can be determined with certainty. In a specifically preferred form the folded tabular grains consist essentially of silver chloride, no other halide being intentionally introduced during grain preparation. Bromide concentrations are limited to 5 mole percent or less, and it is preferred to limit iodide concentrations to 2 mole percent or less.

In addition to knowing the general shape of the grains and their halide content, it has been observed that the folded tabular grains possess a high level of morphological stability. That is, the grains show no tendency toward reversion to other crystalline forms after they are formed.

Figure 1B:
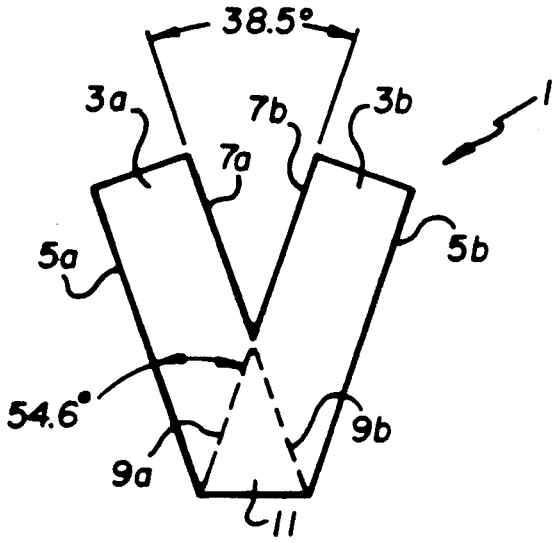
FIG. 1B is an edge view drawing demonstrating a theoretical structure of a folded tabular grain.

The morphological stability of the folded tabular grains together with their geometrical configuration has led to the belief that the diverging tabular portions of the folded tabular grains present {100} major faces. FIG. 1B shows a theoretical model of a folded tabular grain 1 in which diverging tabular portions 3*a* and 3*b* of the grain have {100} major outer faces 5*a* and 5*b* and inner faces 7*a* and 7*b* that diverge at an angle of 38.5°. It has been theorized that this orientation of the diverging tabular portions of the grains can result from formation of {111} twin planes 9*a* and 9*b* at the intersection of a common joining portion 11 of the grain with each diverging tabular portion. The angle between each twin plane and the outer major face of the adjacent tabular portion of the folded grain is shown as 54.6°. Support for this theoretical model of folded tabular grain structure is provided by investigations of similar grain shapes in barium titanate crystals reported by E.A.D. White, "Twinning in Barium Titanate Crystals", Acta Cryst.(1955) 8, 845. Although theory and performance suggests that the major faces of the folded tabular grains lie in {100} crystallographic planes and that the configuration of the grains is the product of internal twinning, this has not been proven to the point of certainty for the silver halide grains. Therefore only the features discussed above that can be definitely verified are relied upon to define the invention.

The ≧95 mole percent chloride folded tabular grain emulsions of the invention have been realized by the discovery of a novel process for their preparation. The process is comprised of a grain nucleation step in which silver ion is introduced into a dispersing medium containing at least a 0.5 molar concentration of chloride ion and grain growth is undertaken in the presence of a 2-hydroaminoazine or xanthinoid morphological modifier. Either single-jet or double-jet precipitation techniques can be employed. Grain growth is controlled to favor the formation of folded tabular grains accounting for at least 50 percent of total grain projected area by maintaining in the dispersing medium a pH in the range of from 1 to 8 and an effective concentration of the morphological modifier in the range of from a $5\times10^{-5}$ to $2\times10^{-2}$ millimolar concentration.

As herein employed, the term "effective concentration" as applied to the morphological modifier refers to the active species of the morphological modifier that is present. For a 2-hydroaminoazine type morphological modifier this is the unprotonated form of the morphological modifier. For a xanthinoid type morphological modifier this is the deprotonated form of the morphological modifier. The total amount of the morphological modifier added to the dispersing medium is, of course, known. The effective amount can be calculated from this knowledge of the pH of the dispersing medium and the pKa of the morphological modifier—that is, the negative logarithm or log of the acid dissociation constant of the morphological modifier.

The total concentration of the morphological modifier and the effective concentration of the morphological modifier are related in the following manner:

$$EC=TC\div[1+10^{(pKa-pH)}]$$

where

EC is the millimolar effective concentration of the morphological modifier;

TC is the millimolar total concentration of the morphological modifier;

pKa is the negative logarithm (log) of the acid dissociation constant of the morphological modifier; and pH is the negative logarithm (log) of the hydrogen ion concentration.

The purpose of maintaining at least a 0.5 molar concentration of chloride ion in the dispersing medium at nucleation is to induce the formation of twin planes in the grain nuclei as they are formed. The chloride level in the reaction vessel can range upwardly to the saturation level of the soluble salt used to supply the chloride ion. However, in practice, it is preferred to maintain the chloride ion concentration below saturation levels, preferably up to 2.0 molar concentrations at nucleation, to avoid any tendency toward peptizer precipitation and elevated levels of viscosity of the aqueous solution in the reaction vessel. At these chloride ion concentration levels the necessary twinning for folded tabular grains can be prior to adding more than 10 percent of the total silver ion. This avoids degradation of tabular properties in the grains Once twinning has been introduced into the grains, the chloride ion concentration levels can range down to 0.01 molar, but are preferably maintained in the range of from about 0.5 to 2 molar, optimally from 0.5 to 1 molar.

The 2-hydroaminoazines and xanthinoid compounds employed in the practice of this invention have also been disclosed to be useful in the art as morphological stabilizers in the preparation of high chloride {111} tabular grain emulsions. In that prior art use the compounds are relied upon the stabilize the {111} major faces of the tabular grains. In the present invention it is believed that the tabular grains have {100} major faces. Further, the effective concentrations of these compounds as employed in the practice of this invention fall below the lower limits of usefulness for these compounds taught by the prior art. The role 2-hydroaminoazines and xanthinoid morphological modifiers perform in the practice of the present invention is to provide the folded grain configuration. This grain configuration is absent from high chloride {111} tabular grain emulsions. It is quite surprising that the same compounds that are relied upon to produce high chloride {111} tabular grains can produce high chloride grains of an entirely different shape when incorporated in the dispersing medium during grain growth in the effective concentrations taught.

The morphological modifier can be present in the dispersing medium prior to the start of precipitation or can be added at the start of the grain growth step. It is preferable to incorporate the morphological modifier into the dispersing medium of the reaction vessel after grain nucleation. Since grain nucleation occurs instantaneously upon introduction of silver ion, morphological modifier is preferably added after silver ion introduction has commenced.

Silver ion can be added in any convenient conventional manner. Typically silver ion is introduced as a silver salt solution, typically silver nitrate. In single-jet precipitation no additional halide ion is introduced into the dispersing medium beyond that initially present. In double-jet precipitation chloride ion or a mixture of chloride ion with bromide and/or iodide ion can be added in the ratios satisfying halide composition requirements noted above. Halide ion is typically added in the form an alkali halide or alkaline earth salt solution.

Preferably, additional chloride ion can be introduced into the reaction vessel as precipitation progresses. This has the advantage of allowing the chloride concentration level of the reaction vessel to be maintained at or near an optimum molar concentration level. Thus, double-jet precipitation can be used.

The silver halides which can be used in the invention include silver chloride, silver bromochloride or silver bromoiodochloride. It is preferred to limit the presence of halides other than chloride so that chloride accounts for at least 95 mole percent, based on silver, of the completed emulsion. More particularly, it is preferred to limit bromide concentrations to 5 mole percent or less, based on total silver, and iodide concentrations to 2 mole percent or less, based on total silver. More preferably, the folded-tabular grains consist essentially of silver chloride, and most preferably are pure silver chloride grains.

The 2-hydroaminoazine morphological modifiers can be selected from among the same compounds known to be useful morphological stabilizers for the preparation of high chloride {111} tabular grains. The essential structural components of the 2-hydroaminoazine can be visualized from the following formula:

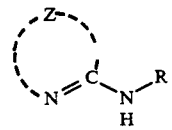

(I)

where

Z represents the atoms completing a 6 member aromatic heterocyclic ring the ring atoms of which are either carbon or nitrogen and R represents hydrogen, any convenient conventional monovalent amino substituent group (e.g., a hydrocarbon or halohydrocarbon group), or a group that forms a five or six membered heterocyclic ring fused with the azine ring completed by Z.

The structural features in formula I that morphologically stabilize the tabular grain {111} crystal faces are (1) the spatial relationship of the two nitrogen atoms shown, (2) the aromatic ring stabilization of the left nitrogen atom, and (3) the hydrogen attached to the right nitrogen atom. It is believed that the two nitrogen atoms interact with the {111} crystal face to facilitate adsorption. The atoms forming R and Z can, but need not, be chosen to actively influence adsorption and morphological stabilization. Various forms of Z and R are illustrated by various species of 2-hydroaminoazines described below.

In one illustrative form the 2-hydroaminoazine can satisfy the formula:

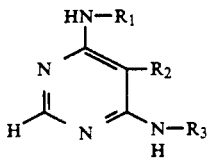

(II)

wherein $R_1$, $R_2$ and $R_3$, which may be the same or different, are H or alkyl of 1 to 5 carbon atoms; $R_2$ and $R_3$ when taken together can be $—CR_4{=}CR_5$ or $—CR_4{=}N—$, wherein $R_4$ and $R_5$, which may be the same or different are H or alkyl of 1 to 5 carbon atoms, with the proviso that when $R_2$ and $R_3$ taken together form the $—CR_4{=}N—$ linkage, $—CR_4{=}$ must be joined to the ring at the $R_2$ bonding position.

In another illustrative form the 2-hydroaminoazine can satisfy the following formula:

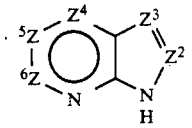

(III)

where $Z^2$ is $—C(R^2){=}$ or $—N{=}$;

$Z^3$ is $—C(R^3){=}$ or $—N{=}$;

$Z^4$ is $—C(R^4){=}$ or $—N{=}$;

$Z^5$ is $—C(R^5){=}$ or $—N{=}$;

$Z^6$ is $—C(R^6){=}$ or $—N{=}$;

with the proviso that no more than one of $Z^4$, $Z^5$ and $Z^6$ is $—N{=}$;

$R^2$ is H, $NH_2$ or $CH_3$;

$R^3$, $R^4$ and $R^5$ are independently selected, $R^3$ and $R^5$ being hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$.

In an additional illustrative form the 2-hydroaminoazine can take the form of a triamino-pyrimidine grain growth modifier containing mutually independent 4, 5 and 6 ring position amino substituents with the 4 and 6 ring position substituents being hydroamino substituents. The 2-hydroaminoazine in this form can satisfy the formula:

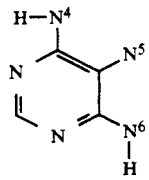

(IV)

where $N^4$, $N^5$ and $N^6$ are independent amino moieties. In a specifically preferred form the 2-hydroaminoazines satisfying formula IV satisfy the following formula:

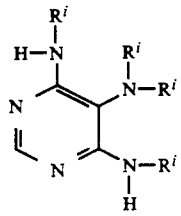

(V)

where $R^i$ is independently in each occurrence hydrogen or alkyl of from 1 to 7 carbon atoms.

In still another illustrative form the 2-hydroaminoazine can satisfy the formula:

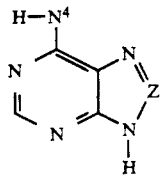

(VI)

where $N^4$ is an amino moiety and

Z represents the atoms completing a 5 or 6 member ring.

The following list sets forth illustrations of various 2-hydroaminoazine morphological modifiers within the contemplation of the present invention:

PY-1 4,5,6-Triaminopyrimidine

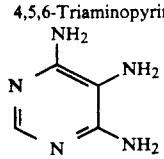

PY-2 5,6-Diamino-4-(N-methylamino)pyrimidine

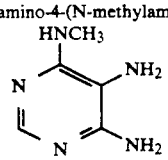

PY-3 4,5,6-Tri(N-methylamino)pyrimidine

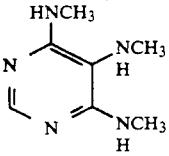

Py-4 4,6-Diamino-5-(N,N-dimethylamino)pyrimidine

-continued

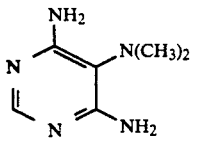

PY-5 4,6-Diamino-5-(N-hexylamino)pyrimidine

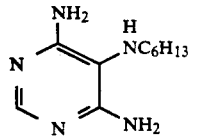

PY-6 Adenine

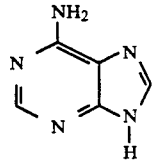

PY-7 6-(N-Methylamino)purine

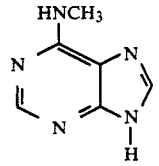

PY-8 6-(N-Ethylamino)purine

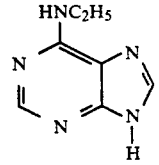

PY-9 6-(N-Butylamino)purine

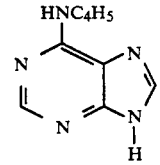

PY-10 6-Amino-7,8-dihydropurine

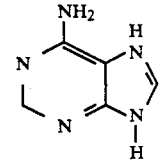

PY-11 4-Amino-7,8-dihydropteridine

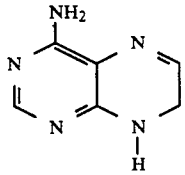

PY-12 4-Amino-5,8-dihydropteridine

-continued

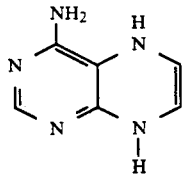

PY-13 4-Amino-5,6,7,8-tetrahydropteridine

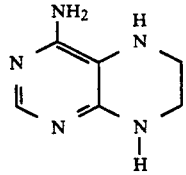

PY-14 8-Azaadenine

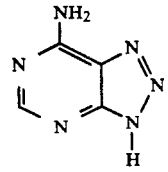

PY-15 6-Benzylaminopurine

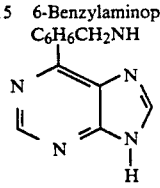

The xanthinoid morphological modifiers include xanthine, 8-azaxanthine and their substituted variants known to be useful a morphological stabilizers for high chloride {111} tabular grains. These xanthinoid compounds include those satisfying the following formula:

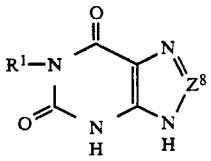

(VII)

where $Z^8$ is $-C(R^8)=$ or $-N=$;

$R^8$ is H, $NH_2$ or $CH_3$; and $R^1$ is hydrogen or a hydrocarbon of from 1 to 7 carbon atoms. The grain growth modifiers of formula I are xanthine and 8-azaxanthine grain growth modifiers, herein referred to generically as xanthinoids or xanthinoid compounds.

When the grain growth modifier is chosen to have a xanthine nucleus, the structure of the grain growth modifier is as shown in the following formula:

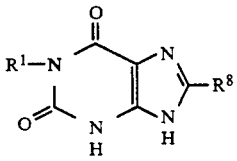

(VIII)

When the grain growth modifier is chosen to have an 8-azaxanthine nucleus, the structure of the grain growth modifier is as shown in the following formula:

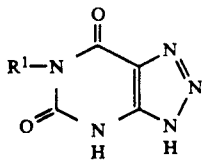

(IX)

No substituents of any type are required on the ring structures of formulae VII to IX. Thus, each of $R^1$ and $R^8$ can in each occurrence be hydrogen. $R^8$ can in addition include a sterically compact hydrocarbon substituent, such as $CH_3$ or $NH_2$. $R^1$ can additionally include a hydrocarbon substituent of from 1 to 7 carbon atoms. Each hydrocarbon moiety is preferably an alkyl group—e.g., methyl, ethyl, n-propyl, i-propyl, n-butyl, i-butyl, t-butyl, etc., although other hydrocarbons, such as cyclohexyl or benzyl, are contemplated. To increase grain growth modifier solubility the hydrocarbon groups can, in turn, be substituted with polar groups, such as hydroxy, sulfonyl or amino groups, or the hydrocarbon groups can be substituted with other groups that do not materially modify their properties (e.g., a halo substituent), if desired.

Exemplary specific xanthinoid compounds are 3,7-dihydro-1H-purine-2,6-dione; 2,6-(1H,3H)-purinedione; 2,6-dioxopurine; xanthine; 1,3-dimethylxanthine; and 1,3,7-trimethylxanthine.

It is typical practice to incorporate from about 20 to 80 percent of the total dispersing medium into the reaction vessel prior to nucleation. At the very outset of nucleation a peptizer is not essential, but it is usually most convenient and practical to place peptizer in the reaction vessel prior to nucleation. Peptizer concentrations of from about 0.2 to 10 (preferably 0.2 to 6) percent, based on the total weight of the contents of the reaction vessel are typical, with additional peptizer and other vehicles typically be added to emulsions after they are prepared to facilitate coating.

An aqueous gelatino-peptizer dispersing medium is preferably present during precipitation, although any conventional peptizer can be employed. Gelatino-peptizers include gelatin—e.g., alkali-treated gelatin (cattle bone and hide gelatin) or acid-treated gelatin (pigskin gelatin) and gelatin derivatives—e.g., acetylated gelatin, phthalated gelatin, and the like.

The process of the invention is not restricted to use with gelatino-peptizers of any particular methionine content. That is, gelatino-peptizers with all naturally occurring methionine levels are useful. It is, of course, possible, though not required, to reduce or eliminate methionine, as taught by Maskasky U.S. Pat. No. 4,713,323 or King et al U.S. Pat. No. 4,942,120, here incorporated by reference.

Precipitation is contemplated over a wide range of pH levels conventionally employed during the precipitation of silver halide emulsions. It is contemplated to maintain the dispersing medium within the pH range of from 1 to 8. It is generally preferred to conduct precipitation in the concentration range from 2 to 6. Within these pH ranges optimum performance of individual morphological modifiers can be observed as a function of their specific structure. A strong mineral acid, such as nitric acid or sulfuric acid, or a strong mineral base, such as an alkali hydroxide, can be employed to adjust pH within a selected range. When a basic pH is to be maintained, it is preferred not to employ ammonium hydroxide, since it has the unwanted effect of acting as a ripening agent and is known to thicken tabular grains. However, to the extent that thickening of the tabular grain portions of the folded tabular grains, ammonium hydroxide or other conventional ripening agents (e.g., thioether or thiocyanate ripening agents) can be present within the dispersing medium. It is generally preferred that each tabular grain portion have a thickness of less than 0.5 μm.

Any convenient conventional approach of monitoring and maintaining replicable pH profiles during repeated precipitations can be employed (e.g., refer to Research Disclosure Vol. 308, Dec. 1989, Item 308,119). Research Disclosure is published by Kenneth Mason Publications, Ltd., Dudley House, 12 North St., Emsworth, Hampshire P010 7DQ, England. Maintaining a pH buffer in the dispersing medium during precipitation arrests pH fluctuations and facilitates maintenance of pH within selected limited ranges. Exemplary useful buffers for maintaining relatively narrow pH limits within the ranges noted above include sodium or potassium acetate, phosphate, oxalate and phthalate as well as tris(hydroxymethyl)-aminomethane.

Once the nucleation and growth steps have been performed the emulsions can be applied to photographic applications following conventional practices. The emulsions can be used as formed or further modified or blended to satisfy particular photographic aims. It is possible, for example, to practice the process of this invention and then to continue grain growth under conditions that degrade the tabularity of the grains and/or alter their halide content. It is also common practice to blend emulsions once formed with emulsions having differing grain compositions, grain shapes and/or grain tabularities.

Examples

The invention can be better appreciated by reference to the following examples illustrating $A_gBr_xCl_{(1-x)}$ folded-tabular grains formed in accordance with the present invention. From visual inspection it was determined that in every instance folded tabular grains accounted for at least 50 percent of total grain projected area. Table I contains a summary of the properties of the emulsions of the Examples. The term "x" in Table I refers to the formula of this paragraph. The term "ECD" designates mean grain equivalent circular diameter in micrometers. Effective concentrations (Eff. Conc.) were calculated by the equation provided above and are reported as millimolar concentrations. The term "regular gelatin" refers to gelatin that was not treated with an oxidizing agent to reduce its methionine content. Regular gelatin typically contains >30 micromoles of methionine per gram of gelatin.

TABLE I

| Emul. No. | 1 − x | Temp °C. | pH | Eff. Conc.. | ECD (μm) | Growth Modifier |
|---|---|---|---|---|---|---|
| A. | 1.00 | 40 | 2.0 | 0.017 | 2.1 | Adenine |
| B. | 1.00 | 60 | 2.0 | 0.007 | 3.3 | Adenine |
| C. | 1.00 | 40 | 2.0 | 0.008 | 3.0 | Adenine |
| D. | 1.00 | 40 | 5.0 | 0.02 | 2.1 | Adenine |
| E. | 1.00 | 40 | 5.0 | 0.0001 | 1.5 | Xanthine |
| F. | 1.00 | 40 | 5.0 | 0.0008 | 1.7 | Xanthine |
| G. | 1.00 | 40 | 2.0 | 0.017 | 0.8 | Adenine |
| H. | 0.97 | 40 | 2.0 | 0.017 | 1.5 | Adenine |

Example I-Emulsion A

Figure 2:
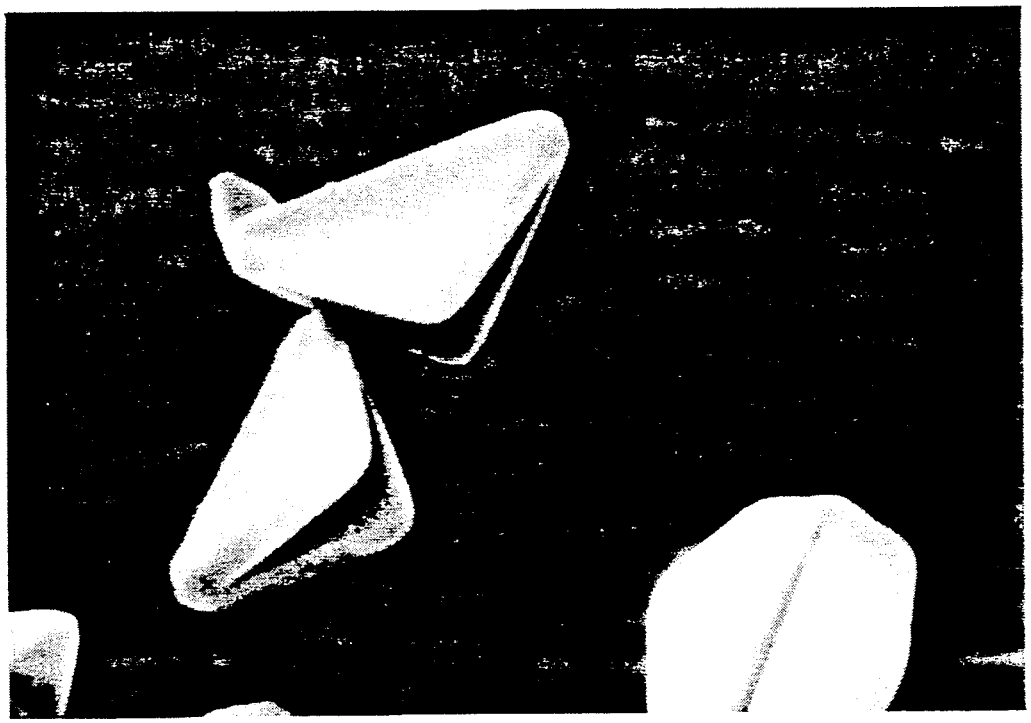
FIG. 2 illustrates a scanning electron micrograph of AgCl (100% chloride) grains produced in accordance with the process of the invention.

A reaction vessel, equipped with a stirrer, was charged with 6000 grams of distilled water containing 60 gram of oxidized gelatin, and 0.5 M of $CaCl_2.2H_2O$. The pH was adjusted to 2.0 at 40° C. and maintained at that value throughout the precipitation by addition of NaOH or $HNO_3$. 1.9 M $AgNO_3$ solution was added over a 4 minute period at a rate consuming 1.6% of the total Ag used. The addition rate was then linearly accelerated over an additional period of 55 minutes (9.32X from start to finish) during which time the remaining 98.4% of the Ag was consumed. The amount of 220 cc of 19.7 mM adenine solution was added after 4, 10 and 28 minutes of precipitation, and 1500 grams of 3M $CaCl_2$ was added at 10 minutes after the precipitation started. During the addition of adenine and $CaCl_2$ solutions, silver flow was stopped for 1 minute to allow the additions to be uniformly mixed. A total of 5.8 moles of silver was consumed in the precipitation. With reference to FIG. 2, there is shown a scanning electron micrograph of the resulting AgCl (100% Chloride) grains.

Example II-Emulsion B

This emulsion was prepared similar to that of Example I, except that the temperature was held at 60° C. throughout the precipitation.

Example III-Emulsion C

This emulsion was prepared similar to that of Example I, except that 0.5 M $AgNO_3$ solution was used and the amount of adenine solution addition was reduced to 110 c.c. each.

Example IV-Emulsion D

This emulsion was prepared similar to that of Example I, except that the reactor pH was held at pH 5, and the amount of adenine solution addition was reduced to 2.0 c.c. each.

Example V-Emulsion E

Figure 3:
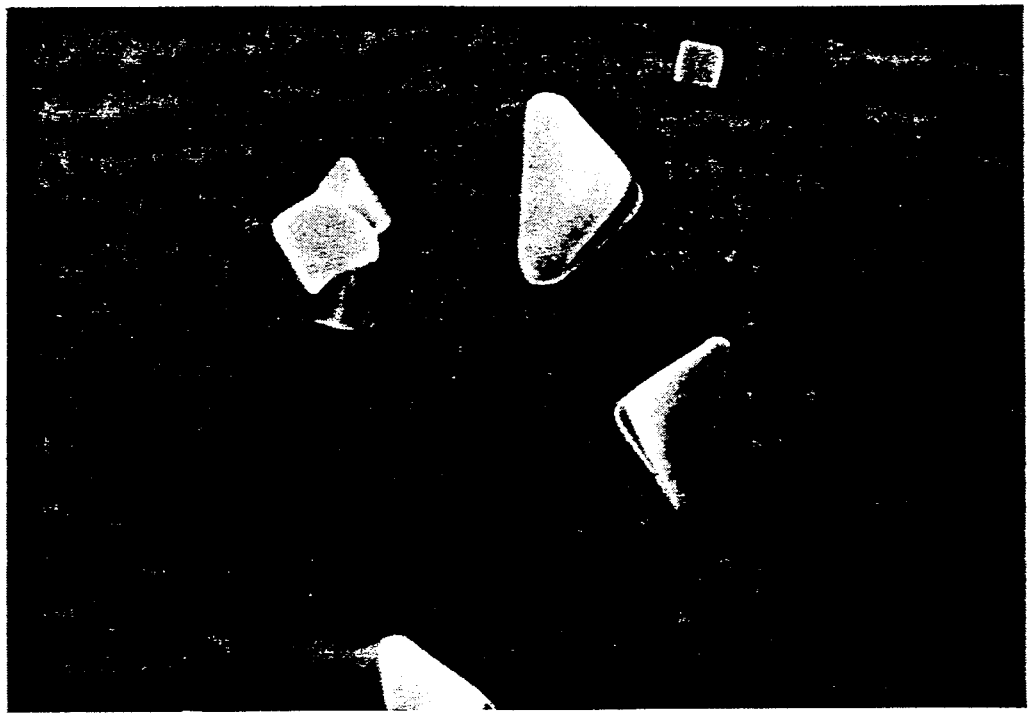
FIG. 3 illustrates a scanning electron micrograph of AgCl (100% chloride) grains produced in accordance with the process of the invention.

The reaction vessel, equipped with a stirrer, was charged with 6000 grams of distilled water containing 30 gram of oxidized gelatin, and 0.5 M of $CaCl_2.2H_2O$. The pH was adjusted to 5.0 at 40° C. and maintained at that value throughout the precipitation by addition of NaOH or $HNO_3$. 0.5 M $AgNO_3$ solution was added over a 4 minute period at a rate consuming 1.6% of the total Ag used. The addition rate was then linearly accelerated over an additional period of 55 minutes (9.32X from start to finish) during which time the remaining 98.4% of the Ag was consumed. 300 c.c. of 0.65 mM xanthine solutions were added after 4, 10 and 28 minutes of the precipitation, and 378 grams of 3M $CaCl_2$ was added at 10 minutes after the precipitation started. During the addition of xanthine and $CaCl_2$ solutions, silver flow was stopped for 1 minute to allow the additions to be uniformly mixed. A total of 1.5 moles of silver was consumed in the precipitation. With reference to FIG. 3, there is shown a scanning electron micrograph of the resulting AgCl (100% Chloride) grains.

Example VI-Emulsion F

This emulsion was prepared similar to that of Example V, except that 80 c.c. of 16.4 mM xanthine solution was added each time.

Example VII-Emulsion G

This emulsion was prepared similar to that of Example I, except that regular gelatin was used.

Example VIII-Emulsion H

This emulsion was prepared similar to that of Example I, except that 3% bromide was added 23 minutes after the start of precipitation.

The invention has been described in detail with particular reference to preferred embodiments thereof, but it will be understood that variations and modifications can be effected within the spirit and scope of the invention.

We claim:

1. A photographic emulsion comprised of a dispersing medium and radiation sensitive silver halide grains, wherein at least 50 percent of the total grain projected area is accounted for by folded tabular grains containing at least 95 mole percent chloride, based on silver.

2. A photographic emulsion according to claim 1, wherein the folded tabular grains have a portion joining two tabular grain portions that diverge at an angle of less than 45°, where the angle of divergence is the projected angle of intersection of the inner major faces of the tabular grain portions.

3. A photographic emulsion according to claim 1, wherein the folded tabular grains contain less than 2 mole percent iodide.

4. A photographic emulsion according to claim 1, wherein the folded tabular grains consist essentially of silver chloride.

* * * * *